US005402640A

United States Patent [19]

Uchikawa

[11] Patent Number: 5,402,640

[45] Date of Patent: Apr. 4, 1995

[54] AIR-FUEL RATIO CONTROL SYSTEM OF INTERNAL COMBUSTION ENGINE

[75] Inventor: Akira Uchikawa, Atsugi, Japan

[73] Assignee: Unisia Jecs Corporation, Atsugi, Japan

[21] Appl. No.: 257,894

[22] Filed: Jun. 10, 1994

[30] Foreign Application Priority Data

Jun. 11, 1993 [JP] Japan ..... 5-140863

[51] Int. Cl.[6] ..... F01N 3/20

[52] U.S. Cl. ..... 60/276; 60/277; 60/285; 123/674; 123/691

[58] Field of Search ..... 60/274, 276, 277, 285; 123/691, 674, 703

[56] References Cited

U.S. PATENT DOCUMENTS

| | | | |
|---|---|---|---|
| 5,025,767 | 6/1991 | Kume | 60/276 |
| 5,056,308 | 10/1991 | Kume | 60/285 |
| 5,060,474 | 10/1991 | Aramaki | 60/277 |
| 5,251,437 | 10/1993 | Furuya | 60/285 |
| 5,255,662 | 10/1993 | Nakajima | 60/276 |
| 5,335,493 | 8/1994 | Uchida | 60/285 |
| 5,337,555 | 8/1994 | Tokuda | 60/276 |
| 5,337,558 | 8/1994 | Komatsu | 60/277 |

FOREIGN PATENT DOCUMENTS 4-072438 3/1992 Japan .

*Primary Examiner*—Ira S. Lazarus
*Assistant Examiner*—Daniel J. O'Connor
*Attorney, Agent, or Firm*—Foley & Lardner

[57] ABSTRACT

An air-fuel ratio control system for an internal combustion engine comprises a catalytic converter disposed in an exhaust line of the engine. The converter has an oxygen storage effect. First and second oxygen sensors are disposed in the exhaust line at positions upstream and downstream of the converter respectively. Each sensor varies the output in accordance the oxygen concentration in the exhaust gas flowing in the exhaust line. A first device is employed for deriving an air-fuel ratio feedback correction value in accordance with the output from the first oxygen sensor. A second device is employed for changing the air-fuel ratio feedback correction value of the first device in accordance with the output from the second oxygen sensor. A third device is employed for controlling the quantity of fuel fed to the engine in accordance with the air-fuel ratio feedback correction value derived by the first device. A fifth device is employed for detecting a converged condition of the oxygen storage effect of the catalytic converter. A fifth device is also employed for enabling the second device to operate only when the fourth device detects the converged condition of the oxygen storage effect of the converter.

7 Claims, 4 Drawing Sheets

AIR-FUEL RATIO CONTROL SYSTEM OF INTERNAL COMBUSTION ENGINE

BACKGROUND OF THE INVENTION

1. Field of the Invention

The present invention relates in general to an air-fuel ratio control system of internal combustion engine, which controls the air-fuel ratio of the mixture fed to the engine in accordance with the condition of gas exhausted from the engine. More particularly, the present invention relates to the air-fuel ratio control systems of a type which carries out a feedback control to the air-fuel ratio by processing the information signals (or outputs) from two oxygen sensors arranged upstream and downstream of an oxygen storage type catalytic converter arranged in the exhaust line of the engine.

2. Description of the Prior Art

In order to clarify the task of the present invention, one conventional air-fuel ratio control system of the above-mentioned type will be described, which is disclosed in Japanese Patent First Provisional Publication 4-72438.

In the system, first and second oxygen sensors are arranged upstream and downstream of a three-way catalytic converter (oxygen storage type). Outputs from the two oxygen sensors are processed by a computer to carry out a feedback control to the air-fuel ratio of the mixture fed to the engine. That is, based on the output from the first (viz., upstream) oxygen sensor, a feedback correction factor is set by way of proportional-plus-integral control, and based on the output from the second (viz., downstream) oxygen sensor, richer/leaner condition of the exhaust gas from the three-way converter relative to a target value is detected. By correcting the proportional part of the proportional-plus-integral control with reference to the richer/leaner condition thus detected, the control point of the air-fuel ratio feedback control based on the output from the first oxygen sensor is compensated or corrected.

However, due to its inherent construction, the above-mentioned air-fuel ratio feedback control system has a drawback. That is, when, for executing a mixture leaning control by for example fuel cut or the like, the air-fuel ratio feedback control is paused and thereafter the feedback control is reopened by stopping the mixture leaning control, the compensation action effected by the output from the second (downstream) oxygen sensor becomes too large due to the oxygen storage effect possessed by the catalyst of the three-way converter, which deteriorates the nature of the exhaust gas.

As is known, the oxygen storage effect means the oxygen absorbing performance of the three-way catalyst, so that when the air-fuel mixture is leaner, excessive oxygen thus remaining in the exhaust gas from the engine is adsorbed by the catalyst and when thereafter the air-fuel mixture becomes richer, carbon monoxide (CO) and hydrocarbon (HC) in the exhaust gas are reacted with the oxygen which has been adsorbed by the catalyst.

That is, under the mixture leaning control such as fuel cut operation or the like, excessive amount of oxygen thus remaining in the exhaust gas from the engine is adsorbed by the three-way catalyst. Thus, even when thereafter a richer exhaust gas is applied to the catalyst due to stopping of the mixture leaning control, the gas exhausted from the converter fails to show the richer condition thereof until the oxygen adsorbed by the catalyst is fully reacted with the carbon monoxide (CO) and hydrocarbon (HC) in the exhaust gas from the engine. That is, for a while, the second (downstream) oxygen sensor is forced to issue an information signal (or output) representing a leaner condition of the exhaust gas irrespective of the richer condition of the gas at the upstream position of the converter. Accordingly, as is seen from FIG. 4, the time when the second (downstream) oxygen sensor can detect the sharp change of the air-fuel ratio toward a richer side due to stopping of the mixture leaning control is greatly delayed with respect to the time when the change toward the richer side of the air-fuel ratio of the exhaust gas applied to the converter is actually carried out. In this case, a mixture enriching control tends to take place prior to the detecting of the sharp change of the air-fuel ratio by the second oxygen sensor, which induces an erroneous over correction of the air-fuel ratio of the mixture toward a richer side.

SUMMARY OF THE INVENTION

It is therefore an object of the present invention to provide an air-fuel ratio control system of internal combustion engine, which is free of the above-mentioned drawback.

According to the present invention, there is provided an air-fuel ratio control system for an internal combustion engine. The system comprises a catalytic converter disposed in an exhaust line of the engine, the converter having an oxygen storage effect; first and second oxygen sensors disposed in the exhaust line at positions upstream and downstream of the converter respectively, each sensor varying the output in accordance the oxygen concentration in the exhaust gas flowing in the exhaust line; first means for deriving an air-fuel ratio feedback correction value in accordance with the output from the first oxygen sensor; second means for changing the air-fuel ratio feedback correction value of the first means in accordance with the output from the second oxygen sensor; third means for controlling the quantity of fuel fed to the engine in accordance with the air-fuel ratio feedback correction value derived by the first means; fourth means for detecting a converged condition of the oxygen storage effect of the catalytic converter; and fifth means for enabling the second means to operate only when the fourth means detects the converged condition of the oxygen storage effect of the converter.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
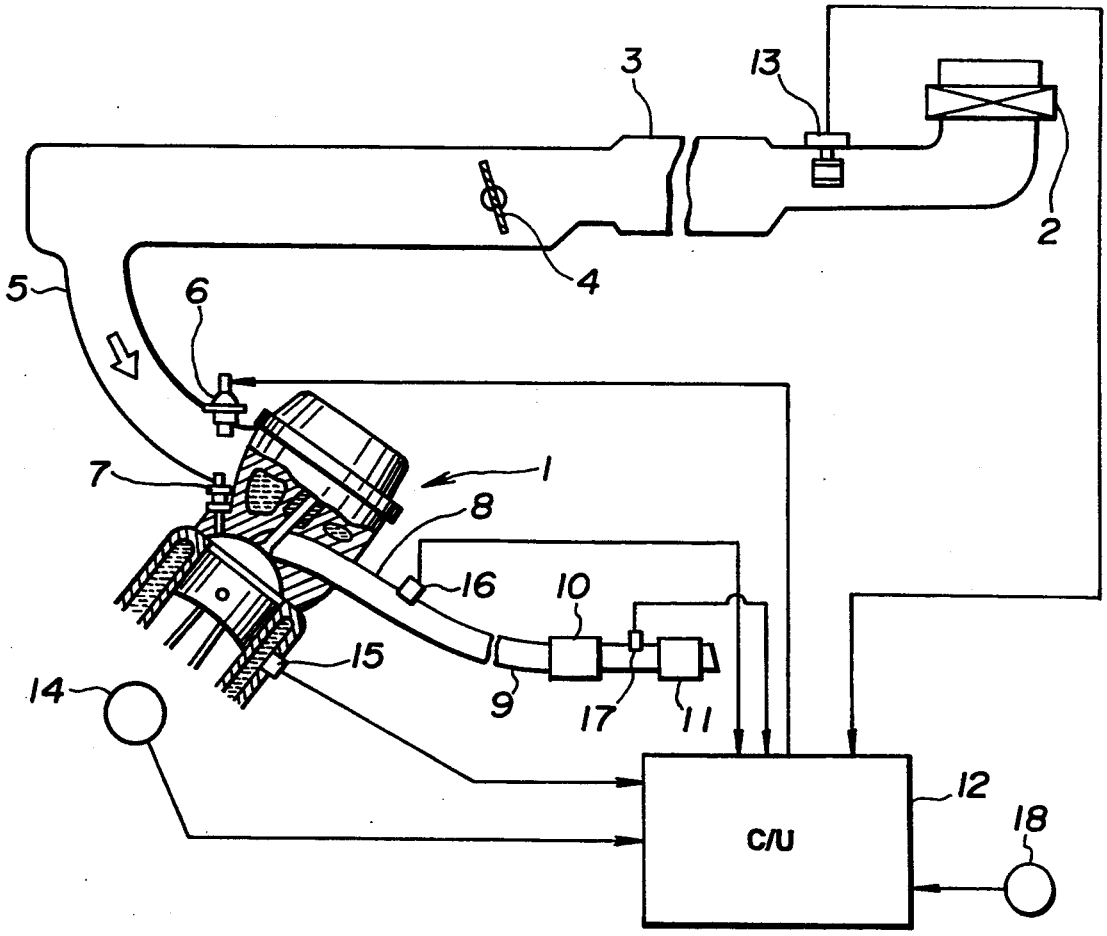
FIG. 1 is a drawing schematically showing an air-fuel ratio control system of the present invention.

Referring to FIG. 1 of the drawings, there is schematically shown an air-fuel ratio control system according to the present invention. In the drawing, denoted by numeral 1 is an internal combustion engine into which fresh air is introduced through an air cleaner 2, an intake duct 3, a throttle valve 4 and an intake manifold 5.

Branch portions of the intake manifold 5 are provided with fuel injection valves 6 for respective engine cylinders. The fuel injection valves 6 are of an electromagnetic type including a solenoid. That is, when the solenoid is energized, the valve is opened, while, when the solenoid is deenergized, the valve is closed. Although not shown in the drawing, each valve 6 is connected to a fuel pump through a pressure regulator. When receiving a pulse signal from a control unit 12 upon requirement of fuel injection, each valve 6 is opened thereby to inject the pressurized fuel into the intake manifold 5, that is, into a corresponding cylinder. That is, in this disclosed embodiment, a so-called "multi-point injection system (MPI)" is employed. However, if desired, a so-called "single-point injection system (SPI)" may be employed in place of the multi-point injection system (MPI). In the SPI, only one injection valve is used, which is arranged upstream of the throttle valve to feed the fuel to all the cylinders in order.

Each combustion chamber of the engine 1 is equipped with an ignition plug 7 by which the air-fuel mixture led into the combustion chamber is ignited.

The engine 1 has an exhaust line which comprises an exhaust manifold 8, an exhaust duct 9, a three-way catalytic converter 10 and a muffler 11. The catalyst of the converter 10 is of the three-way type having the oxygen storage effect. That is, the catalyst can handle HC, CO and NOx in the exhaust gas to convert them into harmless ones. The converter 10 exhibits the maximum converting efficiency when handling the exhaust gas produced from an air-fuel mixture of stoichiometric air-fuel ratio.

The control unit 12 has a microcomputer which comprises CPU, ROM, RAM, A/D converter and I/O interface. Outputs issued from various sensors are fed to the control unit 12 and processed in an after-mentioned manner to control operation of the fuel injection valves 6.

These sensors are an air-flow meter 13, a crank angle sensor 14, a cooling water temperature sensor 15, first and second oxygen sensors 16 and 17 and a vehicle speed sensor 18.

The air-flow meter 13 is of heating wire type or flap type, which is mounted in the intake duct 3 to issue a voltage signal representing an air amount "Q" fed to the engine 1. The crank angle sensor 14 issues a reference angle signal "REF" each time a piston takes a given position and issues a unit angle signal "POS" each time the engine crank turns by a unit angle. It is to be noted that by measuring the production cycle of the reference angle signal "REF" or by measuring the number of the unit angle signals "POS" produced in a given time, the engine speed "Ne" can be derived. The cooling water temperature sensor 15 detects the temperature "Tw" of cooling water which flows in a water jacket in the engine 1.

The first (upstream) oxygen sensor 16 is disposed in a downstream junction portion of the exhaust manifold 8, which is upstream with respect to the three-way catalytic converter 10. The second (downstream) oxygen sensor 17 is disposed in the exhaust duct 9 between the catalytic converter 10 and the muffler 11. The first and second oxygen sensors 16 and 17 are of a known type which changes the output in accordance with the oxygen concentration in the exhaust gas. That is, by practically using the fact that the oxygen concentration in the exhaust gas is sharply changed at the point of stoichiometric air-fuel ratio, the oxygen sensor can detect richer or leaner condition of the exhaust gas.

The vehicle speed sensor 18 detects the speed "VSP" of the vehicle on which the engine 1 is mounted.

Figure 2:
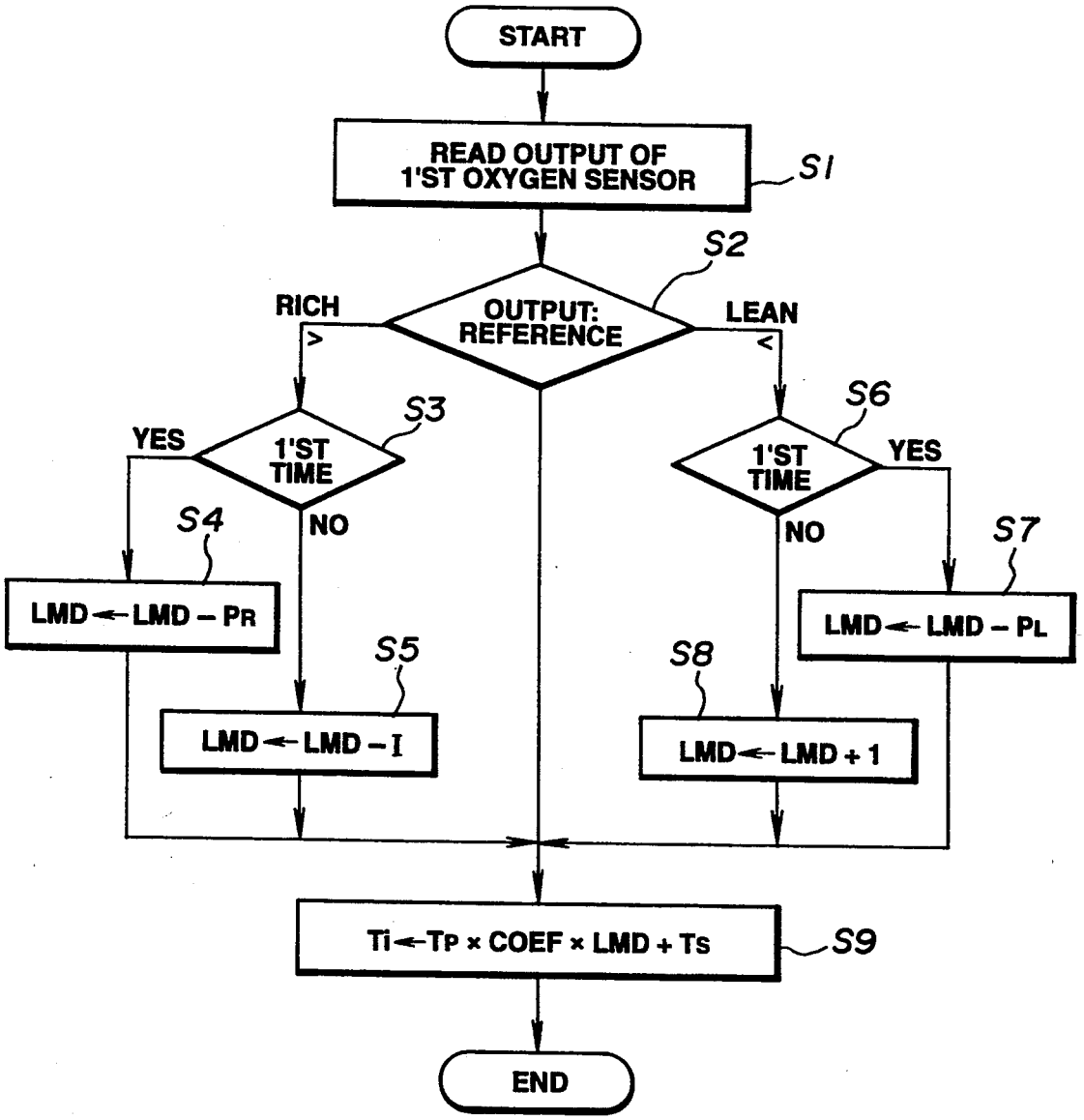
FIG. 2 is a flowchart showing operation steps executed in a computer employed in the system of the invention for carrying out an air-fuel ratio feedback control.
Figure 3:
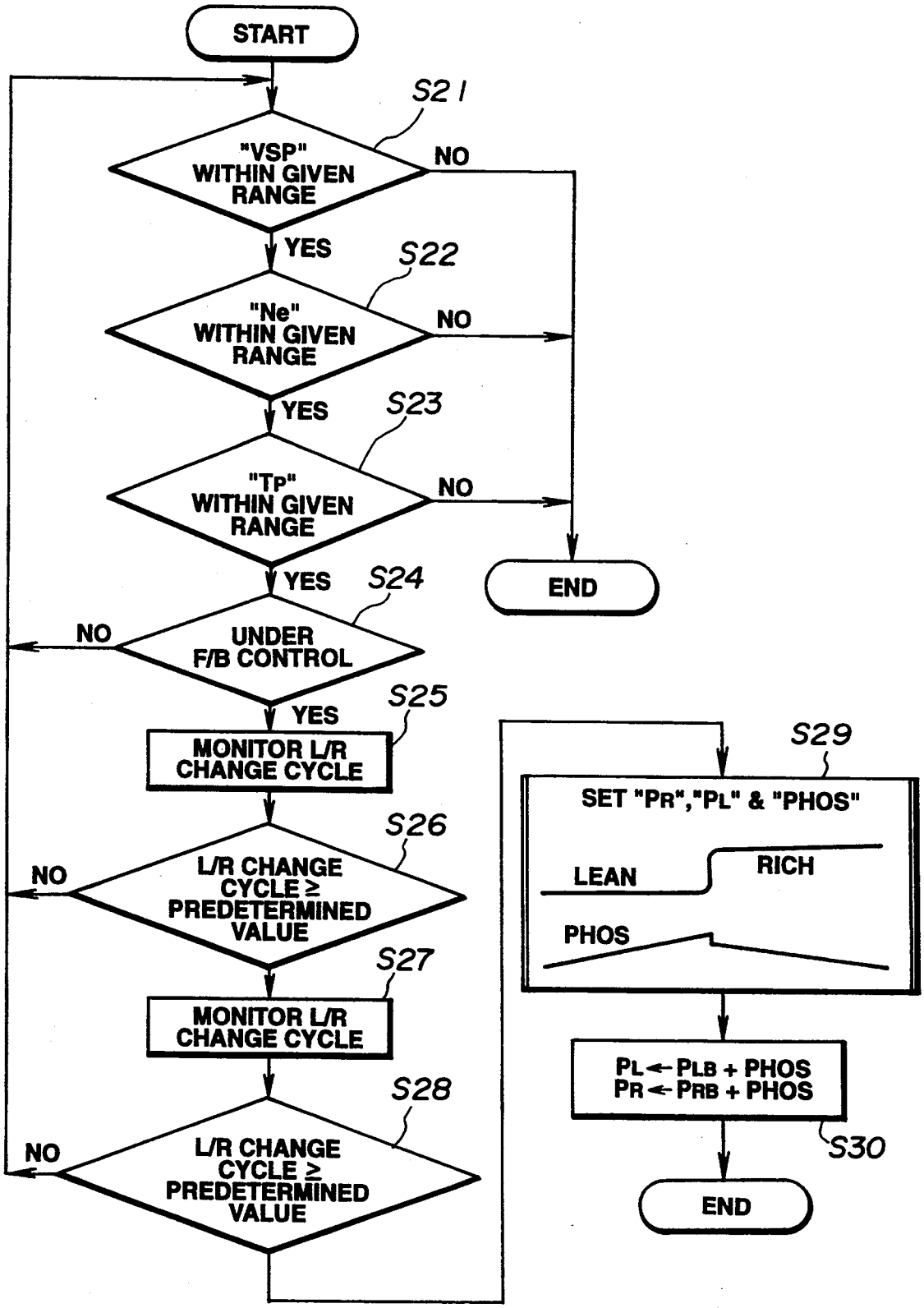
FIG. 3 is a flowchart showing operation steps executed in the computer for carrying out correction control by using an information signal (or output) from a downstream oxygen sensor.
Figure 4:
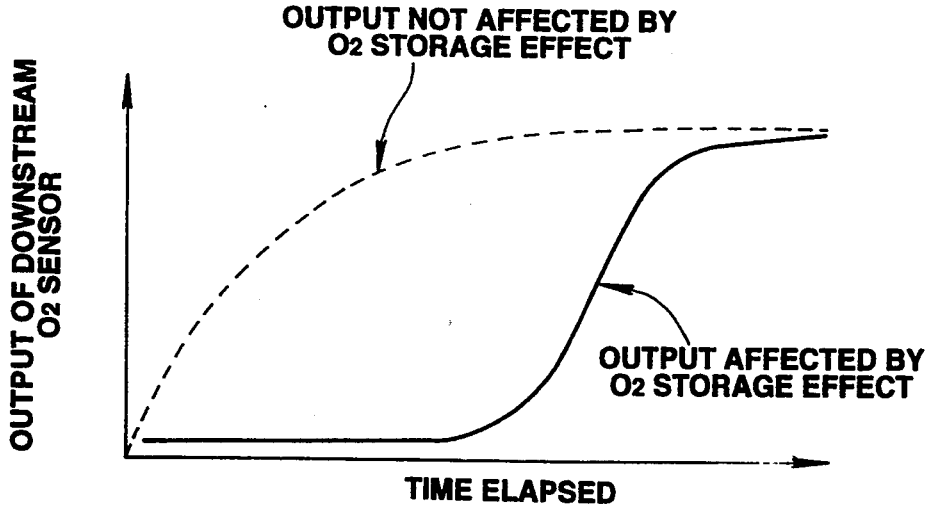
FIG. 4 is a graph showing a delay in response time caused by an oxygen storage effect possessed by a three-way catalytic converter.

The CPU of the computer installed in the control unit 12 carries out the operation steps shown in the flowcharts of FIGS. 2 and 3 to effect an air-fuel ratio feedback control to the mixture fed to the engine 1.

It is to be noted that after-mentioned various means are possessed by software executed by the computer of the control unit 12, in a manner as is depicted by the flowcharts of FIGS. 2 and 3.

FIG. 2 shows a flowchart of programmed operation steps used for setting a fuel injection quantity "Ti". That is, by way of proportional-plus-integral control, an air-fuel ratio feedback correction factor "LMD" is derived, and by using the air-fuel ratio feedback correction factor "LMD" thus derived, the fuel injection quantity "Ti" is derived.

In the flowchart of FIG. 2, at step S1, an output voltage generated by the first oxygen sensor 16 is read. At step S2, a comparison is carried out between the output voltage thus read and a reference voltage which corresponds to a target air-fuel ratio, so that a judgment can be carried out as to whether the exhaust gas just emitted from the engine 1 is richer or leaner. When the output voltage of the first oxygen sensor 16 is higher than the reference voltage and thus the judgment is so made that the exhaust gas is richer than stoichiometric, the operation flow goes to step S3. At this step, a judgment is carried out as to whether the judgment that the exhaust gas is richer than stoichiometric (which will be referred to as "richer-judgment" hereinafter) has taken place at the first time or not. If Yes, that is, when such richer-judgment has taken place at the first time, the operation flow goes to step S4. At this step, a proportional control is carried out in which an after-mentioned proportional part "$P_R$" is subtracted from a previously set air-fuel ratio feedback correction factor "LMD", so that the correction factor "LMD" is updated.

While, if No at step S3, that is, when such richer-judgment has not taken place at the first time, the operation flow goes to step S5. At this step, an integral control is carried out in which a predetermined integral part "I" is subtracted from a previously set air-fuel ratio feedback correction factor "LMD", so that the correction factor "LMD" is updated.

Because the subtraction control applied to the air-fuel ratio feedback correction factor "LMD" corresponds to a fuel reduction control for the fuel injection quantity "Ti", repeating the integral control at step S5 brings about an opposite condition, that is, leaner condition of the exhaust gas just emitted from the engine 1.

When this leaner condition is judged at step S2, the operation flow goes to step S6. At this step, a judgment is carried out as to whether the judgment that the exhaust gas is leaner than stoichiometric (which will be referred to "leaner-judgment" hereinafter) has taken place at the first time or not. If Yes, that is, when such leaner-judgment has taken place at the first time, the operation flow goes to step S7. At this step, a proportional control is carried out in which an after-mentioned proportional part "$P_L$" is added to a previously set air-fuel ratio feedback correction factor "LMD", so that the correction factor "LMD" is updated.

While, if No at step S6, that is, when such leaner-judgment has not taken place at the first time, the operation flow goes to step S8. At this step, an integral control is carried out in which a predetermined integral part "I" is added to a previously set air-fuel ratio feedback correction factor "LMD", so that the correction factor "LMD" is updated.

As is described hereinabove, the air-fuel ratio feedback correction factor "LMD" is subjected to the proportional-plus-integral control so that the real air-fuel ratio of the exhaust gas detected by the first oxygen sensor 16 is brought toward the target air-fuel ratio.

Then, the operation flow goes to step S9. At this step, a basic fuel injection quantity "Tp" is corrected with reference to the updated correction factor "LMD" to provide a practical fuel injection quantity "Ti".

More specifically, the basic fuel injection quantity "Tp" is derived from the following equation:

$$Tp = K \times Q/Ne \quad (1)$$

wherein:

*K*: constant

*Q*: air amount fed to engine

*Ne*: engine speed

In addition, a correction factor "COEF" based on various operation conditions such as the cooling water temperature "Tw" and the like and a voltage correction part "Ts" based on the voltage of a battery mounted on the vehicle are calculated.

Then, the practical fuel injection quantity "Ti" is derived from the following equation:

$$TI = Tp \times COEF \times LMD + Ts \quad (2)$$

To the fuel injection valves 6, the control unit 12 outputs, at a given timing, pulse signals whose pulse width corresponds to the practical fuel injection quantity "Ti" thus derived. With this, the fuel injection valves 6 are controlled to provide an air-fuel mixture having the target air-fuel ratio.

The proportional parts "$P_R$" and "$P_L$" used for carrying out the proportional-plus-integral control of feedback correction factor "LMD" are derived in a manner as shown in the flowchart of FIG. 3.

In the flowchart of FIG. 3, at steps S21 to S23, judgments are carried out as to whether the vehicle speed "VSP", the engine speed "Ne" and the basic fuel injection quantity "Tp" (viz., engine load) are within respective given ranges or not. That is, by these steps, a judgment is carried out as to whether the engine is under middle speed and normal operating condition or not. It is said that when the engine is under such middle speed and normal operating condition, the oxygen storage effect of the three-way catalytic converter 10 becomes easily converged or stable.

When the steps S21 to S23 judge that the engine is under such middle speed and normal operating condition, the operation flow goes to step S24. At this step, a judgment is carried out as to whether the air-fuel ratio feedback control of the flowchart of FIG. 2 is under operation or not. If Yes, that is, when the feedback control is under operation, the operation flow goes to step S25. At this step, the cycle of the air-fuel ratio feedback control, that is, the lean/rich change cycle of the air-fuel ratio detected by the first (upstream) oxygen sensor 16 is monitored.

Then, the operation flow goes to step S26. At this step, a judgment is carried out as to whether the lean/rich change cycle of the air-fuel ratio thus monitored is greater than a predetermined change cycle or not.

As will be understood from the above, the convergent condition in the oxygen storage effect of the three-way catalytic converter 10 can be detected by carrying out the steps S21 to S26.

As will be described in the following, when, with the oxygen storage effect kept converged, the output of the second (downstream) oxygen sensor 17 shows a marked change, an after-mentioned correction control is carried out.

It is to be noted that the converging condition of the oxygen storage effect means a condition wherein the oxygen adsorbing and holding performance of the three-way catalytic converter 10 is stable under the air-fuel ratio feedback control based on the output from the first (upstream) oxygen sensor 16.

When, at step S26, the judgment is so made that the lean/rich change cycle of the air-fuel ratio is greater than the predetermined change cycle, the operation flow goes to step S27. At this step S27, the lean/rich change cycle of the air-fuel ratio detected by the second (downstream) oxygen sensor 17 is monitored.

Then, the operation flow goes to step S28. At this step, a judgment is carried out as to whether the lean/rich change cycle detected by the second oxygen sensor 17 is greater than a predetermined change cycle or not. The predetermined change cycle is for example two, preferably five to six. If No, that is, when the lean/rich change cycle is judged smaller than the predetermined change cycle, the operation flow goes back to step S21 for repeating the steps S21 to S28 until the lean/rich change cycle is judged greater than the predetermined change cycle. Upon the lean/rich change cycle being greater than the predetermined change cycle, the operation flow goes to step S29.

Figure 5:
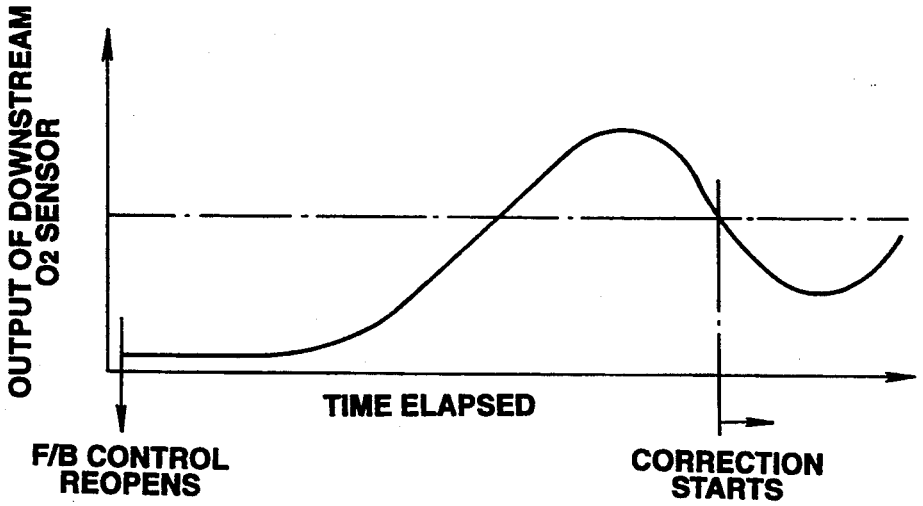
FIG. 5 is a graph showing an improvement in the response time provided by the present invention.

That is, with respect to the time when the air-fuel ratio feedback control based on the output from the first upstream) oxygen sensor 16 starts, an after-mentioned correction to the feedback control, which is based on the output from the second (downstream) oxygen sensor 17, is somewhat delayed, as will be seen from the graph of FIG. 5.

As has been mentioned hereinabove, under the mixture leaning control such as fuel cut operation or the like, excessive amount of oxygen is adsorbed by the three-way catalyst. Thus, even when thereafter a richer exhaust gas is applied to the catalyst by stopping the mixture leaning control, the second (downstream) oxygen sensor 17 is forced to issue an output representing a leaner condition of the exhaust gas until the oxygen adsorbed by the catalyst is fully consumed. Thus, if, based on the leaner condition representing signal issued by the second oxygen sensor 17, the air-fuel ratio feedback control depicted by the flowchart of FIG. 2 is corrected to have the control point shifted toward a richer side, the above-mentioned erroneous over correction is inevitably induced.

While, when a certain time passes and the oxygen adsorbed by the catalyst is almost consumed causing the catalytic converter to come to its stable condition, the output of the second (downstream) oxygen sensor 17 comes to show a rich/lean change cycle similar to that possessed by the exhaust gas just emitted from the engine 1 in accordance with the air-fuel ratio feedback control based on the output from the first (upstream) oxygen sensor 16. When the influence of the oxygen storage effect of the catalyst disappears, the output of the second oxygen sensor 17 comes to show rich/lean changes at a given cycle in accordance with the feedback control based on the output from the first (upstream) oxygen sensor 16. At this time, the oxygen storage effect of the catalyst is fully converged.

As is described hereinabove, at step S28, the lean/-rich change cycle of the air-fuel ratio detected by the second oxygen sensor 17 is compared with the predetermined change cycle. That is, when the lean/rich change cycle is judged smaller than the predetermined change cycle, after-mentioned correction to the proportional parts "$P_R$" and "$P_L$" (that is, correction of the control point of the feedback control based on the output from the first oxygen sensor 16) is not carried out. Accordingly, even when, by stopping the mixture leaning control, the air-fuel ratio feedback control based on the output from the first (upstream) oxygen sensor 16 is reopened, correction of the feedback control by using the output from the second (downstream) oxygen sensor 17 does not start until the catalytic converter 10 shows its fully converged condition. Thus, the erroneous over correction to the feedback control, which would take place in the above-mentioned conventional system, is suppressed.

As is described hereinabove, the stable (or conversed) condition of the oxygen storage effect of the catalyst 10 is detected by sensing the lean/rich change cycle being greater than the predetermined change cycle. Thus, even when the second oxygen sensor 17 comes to sense the richer air-fuel ratio of the exhaust gas coming from the catalytic converter 10, the marked delayed response, which may be caused by the influence of the oxygen storage effect exhibited during the mixture leaning control, does not induce an erroneous control of the air-fuel ratio control system.

When, as is described hereinabove, by confirming the converged condition of the oxygen storage effect of the three-way catalytic converter 10, it is judged that the oxygen storage effect exhibited during the mixture leaning control has no wrong effect on the output from the second (downstream) oxygen sensor 17 any longer, the operation flow goes to step S29.

At this step S29, similar to the aforementioned proportional-plus-integral control on the feedback correction factor "LMD" based on the output from the first oxygen sensor 16, by way of a proportional-plus-integral control based on the output from the second oxygen sensor 17, a correction value "PHOS" (initial value=0) for correcting the basic proportional parts "$P_RB$" and "$P_LB$" is so determined that the air-fuel ratio detected by the second oxygen sensor is brought toward a target air-fuel ratio.

Then, at step S30, the following equations are carried out:

$$P_R = P_{RB} - PHOS \quad (3)$$

$$P_L = P_{LB} + PHOS \quad (4)$$

As has been described hereinabove, the proportional part "$P_R$" is used for reducing the value of the air-fuel ratio feedback correction factor "LMD" at the time when the richer-judgment takes place at the first time, and the proportional part "$P_L$" is used for increasing the value of the correction factor "LMD" at the time when the leaner-judgment takes place at the first time. The correction value "PHOS" is reduced at the time when the richer air-fuel ratio is detected by the second"oxygen sensor 17. Thus, during the time when the second oxygen sensor 17 detects the richer condition of the exhaust gas, the mixture leaning operation of the feedback control using the proportional part "$P_R$" becomes more active and the mixture enriching operation of the feedback control using the other proportional part "$P_L$" is dampened. Accordingly, under such condition, the proportional control characteristic of the feedback correction factor "LMD" is so changed as to bring the richer air-fuel ratio detected by the second (downstream) oxygen sensor 17 toward the target value.

That is, under such condition, the control point of the air-fuel ratio feedback control based on the output from the first (upstream) oxygen sensor 16 can be compensated or corrected by the correction value "PHOS" determined by the output from the second (downstream) oxygen sensor 17.

It is to be noted that the above-mentioned correction control by using the output from the second (downstream) oxygen sensor 17 is not limited to the control applied to the above-mentioned proportional parts. That is, if desired, the correction control may be applied to a control to correct a threshold level which is used when judging richer/leaner condition of the exhaust gas by using the output from the first oxygen sensor 16, or may be applied a control to delay the time when a proportional control is actually carried out upon sensing the richer/leaner condition of the exhaust gas by using the first oxygen sensor 16.

As will be understood from the foregoing description, in accordance with the present invention, the erroneous over correction of the feedback control, which would otherwise take place due to the influence of the oxygen storage effect of the three-way catalytic converter, is suppressed or at least minimized.

What is claimed is:

1. An air-fuel ratio control system for an internal combustion engine, comprising:

a catalytic converter disposed in an exhaust line of said engine, said converter having an oxygen storage effect;

first and second oxygen sensors disposed in said exhaust line at positions upstream and downstream of said converter respectively, each sensor varying the output in accordance the oxygen concentration in the exhaust gas flowing in the exhaust line;

first means for deriving an air-fuel ratio feedback correction value in accordance with the output from said first oxygen sensor;

second means for changing said air-fuel ratio feedback correction value of said first means in accordance with the output from said second oxygen sensor;

third means for controlling the quantity of fuel fed to said engine in accordance with the air-fuel ratio feedback correction value derived by said first means;

fourth means for detecting a converged condition of the oxygen storage effect of said catalytic converter; and fifth means for enabling said second means to operate only when said fourth means detects the converged condition of the oxygen storage effect of said converter.

2. An air-fuel ratio control system as claimed in claim 1, in which said third means has a function to lean the air-fuel mixture fed to the engine under a given condition.

3. An air-fuel ratio control system as claimed in claim 2, in which said fourth means detects said converged condition of the oxygen storage effect of the converter when said second oxygen sensor detects that the lean/-rich change cycle of the exhaust gas emitted from said converter is greater than a predetermined change cycle.

4. An air-fuel ratio control system as claimed in claim 3, in which said predetermined change cycle is two.

5. An air-fuel ratio control system as claimed in claim 3, in which said predetermined change cycle is five or six.

6. An air-fuel ratio control system as claimed in claim 1, in which said fourth means operates only when an associated motor vehicle is under middle speed and normal operation condition.

7. An air-fuel ratio control system as claimed in claim 6, in which said fourth means operates only when said first and third means provide a condition wherein the lean/rich change cycle of the exhaust gas detected by said first oxygen sensor is greater than a predetermined change cycle.

* * * * *